US006899151B1

(12) United States Patent
Latka et al.

(10) Patent No.: US 6,899,151 B1
(45) Date of Patent: May 31, 2005

(54) LIGHTED SUPERVISORY SYSTEM FOR A FUEL DISPENSING NOZZLE

(75) Inventors: Walter G. Latka, Homer Glen, IL (US); Richard J. Klima, Darien, IL (US); Ian Francis Jarvie, Woodridge, IL (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/862,711

(22) Filed: Jun. 7, 2004

(51) Int. Cl.[7] ..... B65B 1/04
(52) U.S. Cl. ..... 141/392; 141/94
(58) Field of Search ..... 141/94, 392, 206–216, 141/59; 702/45

(56) References Cited

U.S. PATENT DOCUMENTS

| | | | | |
|---|---|---|---|---|
| 4,005,412 A | | 1/1977 | Leander | |
| 4,140,013 A | | 2/1979 | Hunger | |
| 4,465,209 A | | 8/1984 | Wilder | |
| 4,469,149 A | | 9/1984 | Walkey et al. | |
| 4,934,419 A | * | 6/1990 | Lamont et al. | 141/94 |
| 5,184,309 A | * | 2/1993 | Simpson et al. | 700/283 |
| 5,267,592 A | * | 12/1993 | Kaplan et al. | 141/387 |
| 5,458,170 A | | 10/1995 | Ferguson | |
| 5,605,182 A | | 2/1997 | Oberrecht et al. | |
| 5,717,374 A | | 2/1998 | Smith | |
| 5,729,002 A | | 3/1998 | Samples | |
| 5,784,100 A | * | 7/1998 | Konishi | 348/251 |
| 5,913,180 A | * | 6/1999 | Ryan | 702/45 |
| 5,923,572 A | | 7/1999 | Pollock | |
| 6,061,942 A | | 5/2000 | Alvern | |
| 6,085,805 A | | 7/2000 | Bates | |
| 6,374,870 B1 | | 4/2002 | Muller | |
| 6,522,947 B1 | | 2/2003 | Hartsell, Jr. | |
| 6,571,151 B1 | | 5/2003 | Leatherman | |
| 6,648,031 B1 | * | 11/2003 | Ambrose et al. | 141/94 |

OTHER PUBLICATIONS

Declaration of Walter G. Latka Dated Sep. 7, 2004.
Declaration of Richard J. Klima Dated Sep. 7, 2004.

* cited by examiner

*Primary Examiner*—Steven O. Douglas
(74) *Attorney, Agent, or Firm*—Dinsmore & Shohl LLP

(57) ABSTRACT

A nozzle is provided for a fleet fuel dispensing system. The nozzle includes an input port that is adapted to receive fuel through a fuel supply hose, and a spout that is configured to dispense fuel into a fuel entry receptacle of a vehicle. A valve assembly is configured to couple the input port with the spout, and is further configured to selectively facilitate the passage of fuel from the input port to the spout. A status light is associated with the nozzle and includes a single LED that is connected with a fleet management system. The status light is configured to selectively illuminate as directed by a fleet management system. The illumination provides information as to whether a vehicle is authorized to receive fuel from the spout. A fuel dispensing system having such a nozzle is also provided.

20 Claims, 2 Drawing Sheets

LIGHTED SUPERVISORY SYSTEM FOR A FUEL DISPENSING NOZZLE

TECHNICAL FIELD

The present invention relates to a visual supervisory system for association with a nozzle of a fuel dispensing system. The system includes a status light provided by at least one LED to visually communicate information as to whether a fleet vehicle is authorized to receive fuel from the nozzle, as well as other information as desired.

BACKGROUND OF THE INVENTION

Many commercial enterprises, municipalities, and other entities own and/or operate fleets of vehicles (e.g., cars, vans, trucks, watercraft, aircraft, etc.). Conventional fleet fueling systems have been developed in order that such vehicles can receive fuel from a designated fueling site without the need for the operator of the vehicle to pay for the fuel in a conventional manner at that time. These fleet fueling systems can track the amount of fuel dispensed to a particular vehicle over time such that fleet managers can consolidate payments to the fuel vendor without any need for operators to keep receipts. Also, such a system can help to ensure that the preferred brand and/or type of fuel is provided to the vehicle, and that such fuel can be purchased at an agreed-upon price.

A vehicle must typically be authorized before the vehicle is allowed to receive fuel from a fleet fueling system. Some fleet systems involve the use of a code and/or card that is presented to the system by an operator in order to begin the authorization process. Other systems involve the use of optical or radio frequency (RF) communication between the system and the vehicle to perform such authorization.

Because many designated fleet fueling sites are intended only to provide fuel to the vehicles of one or more particular fleets, these sites need not provide the amenities typically provided by a consumer gasoline station, as the fleet fueling sites are not competing for customers of the typical consumer gasoline stations. For this reason, fleet fueling systems often involve as little expense as necessary, and accordingly are often not provided with elaborate electronic displays, for example, and typically do not have any human attendant on staff to oversee the fueling operations. However, because budget-oriented fleet fueling systems do not involve such amenities, feedback regarding the authorization or progression of the fueling process is typically not available to an operator, and there are occasions where an operator is left to wonder why there is a delay in his vehicle receiving fuel and/or why the fleet fueling system will not dispense fuel. Accordingly, there is a need for a simple and low-cost supervisory or information/authorization indicia system for a fleet fuel dispensing system, whereby this system conveniently provides acknowledgement of authorization and/or fueling status information to an operator.

SUMMARY OF THE INVENTION

It is an aspect of the present invention to provide a simple and low-cost supervisory and authorization system for a fleet fuel dispensing system, whereby lighted indicia conveniently provides authorization and/or fueling status information to an operator. In accordance with one exemplary embodiment of the present invention, a nozzle for a fuel dispensing system is adapted to deliver fuel to fleet vehicles. The nozzle comprises an input port that is adapted to receive fuel through a fuel supply hose, and a spout that is configured to dispense fuel into a fuel entry receptacle of a vehicle. A valve assembly is configured to couple the input port with the spout, and is further configured to selectively facilitate the passage of fuel from the input port to the spout. A status light is associated with the nozzle and comprises a single LED connected with a fleet management system. The status light is configured to selectively illuminate as directed by a fleet management system. This illumination provides information as to whether a vehicle is authorized to receive fuel from the spout.

In accordance with another exemplary embodiment of the present invention, a nozzle for a fuel dispensing system is adapted to deliver fuel to fleet vehicles that have an integrated vehicle identification unit. The nozzle comprises an input port that is adapted to receive fuel through a fuel supply hose, and a spout that is configured to dispense fuel into a fuel entry receptacle of a vehicle. A valve assembly is in selective fluid communication with both the input port and the spout, and is configured to selectively facilitate the passage of fuel from the input port to the spout. An antenna is associated with the nozzle and is configured to communicate with a vehicle. A status light is associated with the nozzle and comprises a first LED that is connected with a fleet management system. The status light is configured to selectively illuminate as directed by a fleet management system. This illumination provides information as to whether a vehicle is authorized to receive fuel from the spout.

In accordance with yet another exemplary embodiment of the present invention, a fuel dispensing system having a lighted supervisory or information arrangement is provided for automatically and conveniently providing fuel to fleet vehicles having an integrated vehicle identification unit. The system comprises a fuel storage tank and a fuel dispenser having a fuel inlet and a fuel outlet. The fuel inlet is connected with the fuel storage tank, and the fuel dispenser is configured to facilitate selective passage of fuel from the fuel inlet to the fuel outlet in response to a control signal. A fleet management system is configured to provide the control signal and a monitoring signal. A fuel supply hose has a first end and a second end. The first end is connected with the fuel outlet, and the fuel supply hose is configured to conduct fuel from the first end to the second end. A fuel nozzle comprises an input port connected to the second end of the fuel supply hose, such that the input port is adapted to receive fuel from the fuel supply hose. A spout is configured to dispense fuel into a fuel entry receptacle of a vehicle, and a valve assembly is configured to couple the input port with the spout. The valve assembly is further configured to facilitate selective passage of fuel from the input port to the spout. A status light is associated with the nozzle and comprises at least one LED that is configured to selectively illuminate as directed by the monitoring signal. This illumination provides information as to whether a vehicle is authorized to receive fuel from the spout.

One advantage of the present invention is its provision of a simple and low-cost supervisory and authorization system for a fleet fuel dispensing system, whereby lighted indicia conveniently provides authorization and/or fueling status information to an operator. Additional aspects, advantages and novel features of the invention will be set forth in part in the description that follows, and in part will become apparent to those skilled in the art upon examination of the following or may be learned with the practice of the invention. The aspects and advantages of the invention may be realized and attained by means of the instrumentalities and combinations particularly pointed out in the appended claims.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF EXEMPLARY EMBODIMENTS

Figure 1:
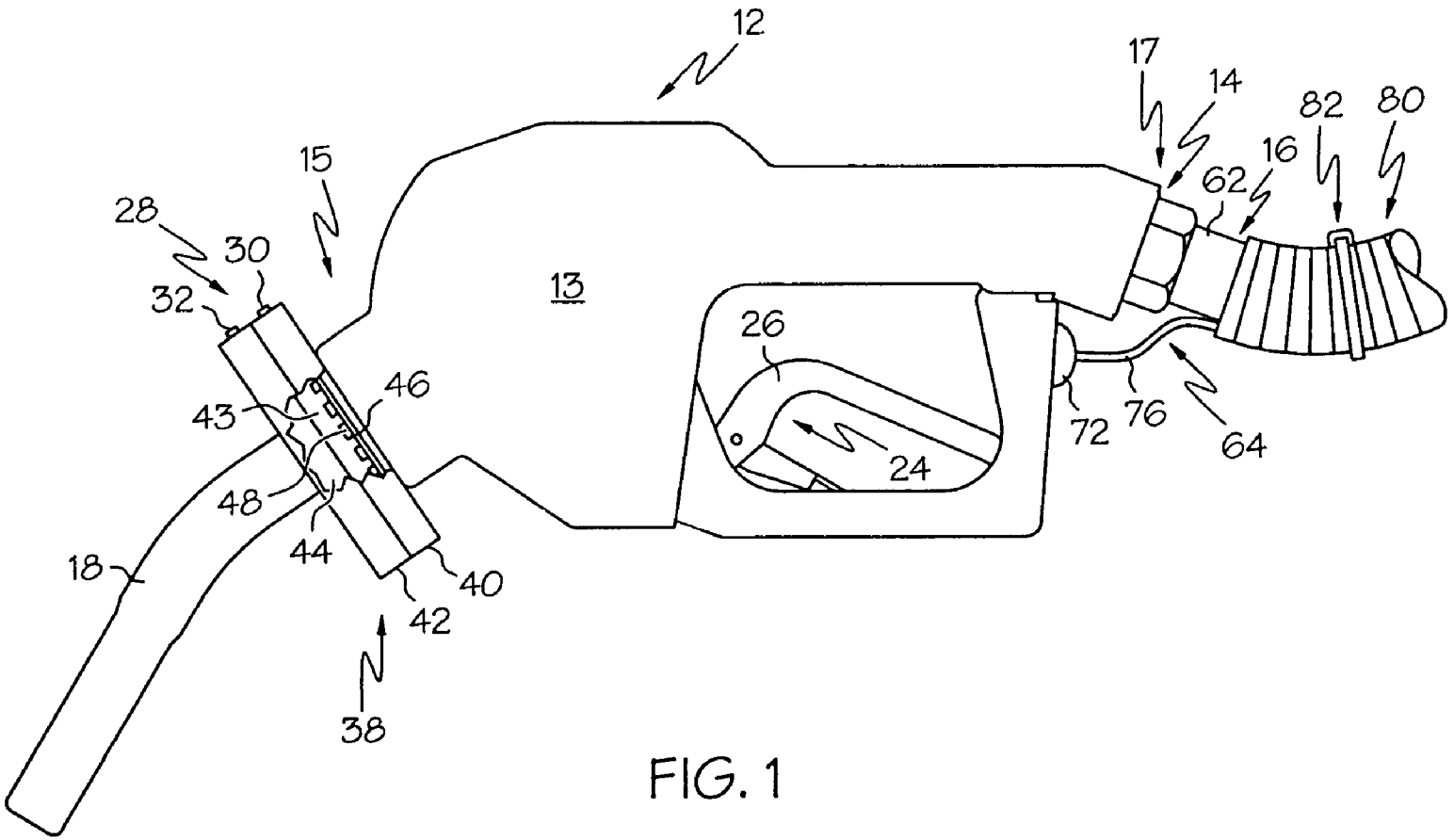
FIG. 1 is a side elevational view of a fuel dispensing nozzle having a status light in accordance with one exemplary embodiment of the present invention, wherein the nozzle's housing is partially broken out such that a circuit board, antenna and other components disposed within the housing are visible.

The present invention and its operation are hereinafter described in detail in connection with the views and examples of FIGS. 1–2, wherein like numbers indicate the same or corresponding elements throughout the views. Referring to FIG. 1, an exemplary nozzle 12 in accordance with the teachings of the system of the present invention is shown to include a body 13. A spout 18 is shown as being attached to body 13 near the front 15 of body 13. The spout 18 can be shaped and sized such that it can be appropriately received in a corresponding fuel entry receptacle of one or more types of vehicles. Such vehicles might include, for example, cars, vans, trucks, watercraft, and/or aircraft.

Nozzle 12 also includes fuel input port 14 disposed near the rear 17 of body 13. Fuel input port 14 can in some embodiments comprise a threaded aperture or another suitable interface for receiving a second end 62 of fuel supply hose 16. Fuel supply hose 16 is shown to be at least partially surrounded by corrugated plastic wrap 80 (i.e., split loom tubing). Fuel supply hose 16 can extend to a fuel pedestal or dispenser (e.g., 54 in FIG. 2), which can ultimately receive fuel from an underground storage tank (e.g., 52 in FIG. 2), for example.

A cable 64 is also shown to be provided within wrap 80 along at least a portion of fuel supply hose 16. In particular, a second section 76 of cable 64 is shown to protrude from wrap 80 and to include a connector 72 for interfacing body 13 of nozzle 12. It should be appreciated that cable 64 might interface with nozzle 12 in a variety of other specific configurations, some of which might not include any such connector 72, and some of which might involve connector 72 being associated with nozzle 12 in any of a variety of alternate locations.

Wrap 80 is shown to be secured around fuel supply hose 16 and cable 64 with one or more fasteners 82 (e.g., bands, wire ties or zip ties). Wrap 80 can extend along substantially the entire length of a fuel supply hose from nozzle 12 to the remote dispenser (e.g., 54 of FIG. 2). This manner of using wrap 80 and fasteners 82 to associate cable 64 with fuel supply hose 16 is simple to install and maintain, is cost-effective, and is sufficiently pliable and durable to facilitate convenient and reliable use of nozzle 12 by an operator while providing at least some protection for fuel supply hose 16 and cable 64. However, it should be appreciated that cable 64 might be associated with fuel supply hose 16 in any of a variety of other configurations. For example, cable 64 might be secured to fuel supply hose 16 without the use of wrap 80, but perhaps only with fasteners (e.g., 82) and/or with bands or sections of heat-shrinkable tubing. As still another example, cable 64 might be partially or fully integrated within fuel supply hose 16. It should therefore be appreciated that cable 64 and fuel supply hose 16 can be associated with each other in any of a variety of specific configurations. In other embodiments of the present invention as discussed below, no cable 64 might be provided at all, and no association between cable 64 and fuel supply hose 16 would in such circumstance be necessary or present.

Swivels, break-away connections, quick-connects, valves, and/or any of a variety of other devices might be installed upon or otherwise provided for cable 64 and/or fuel supply hose 16 to facilitate effective movement of nozzle 12 with respect to dispenser 54 and/or to protect dispenser 54 in the event of a drive-off (i.e., nozzle 12 is forcibly separated from dispenser 54). It will be appreciated that if a swivel is employed in conjunction with fuel supply hose 16, its permitted angle of rotation may be limited or controlled to prevent the associated cable 64 from being stretched or repeatedly wrapped around fuel supply hose 16.

Nozzle 12 can also include a valve assembly 24 having a handle 26. Valve assembly 24 can couple the fuel input port 14 with the spout 18, and can be configured to selectively facilitate the passage of fuel from the fuel input port 14 to the spout 18 in any of a variety of specific manners as are known and appreciated by those skilled in the art. Handle 26 can be selectively engaged by an operator of the nozzle 12 to facilitate this passage of fuel. It should be understood that valve assembly 24, body 13, and/or other mechanical/structural aspects of nozzle 12 can be provided in any of a variety of specific configurations, examples of which are disclosed in U.S. Pat. Nos. 4,453,578 and 6,024,140, both of which are hereby incorporated herein by reference.

A housing 38 is shown as being associated with spout 18, although it could alternatively be associated with any of a variety of other portion(s) of nozzle 12. Housing 38 can be formed from aluminum, steel, plastic, fiberglass, epoxy, brass, composites, and/or any of a variety of other materials or combinations thereof. Housing 38 can include one or more portions, but is shown in FIG. 1 to include a first portion 40 and a second portion 42. The first portion 40 might be formed from aluminum and can be configured to fasten to either spout 18 and/or front 15 of body 13. Second portion 42 can, in one embodiment, comprise a plastic enclosure that matingly interfaces and connects with first portion 40. Although second portion 42 might only be connected with nozzle 12 through first portion 40, it might alternatively be itself directly connected or otherwise indirectly connected with either spout 18 or front 15 of body 13. Fasteners, adhesives, mechanical interlocks, snap-fits, and/or any of a variety of other such devices and/or mating techniques can be used to facilitate this association or connection between housing 38 and nozzle 12.

Together, first portion 40 and second portion 42 can define an internal cavity 43. Within this cavity 43, for example, an antenna 44 and a circuit board 46 can be provided. Antenna 44 can be configured to communicate with a vehicle, such as by receiving information from a vehicle and/or transmitting information to a vehicle. As shown, circuit board 46 might include a processor 48, among other electronic components. A status light 28 can also be associated with housing 38. In this manner, housing 38 can at least partially enclose antenna 44 and processor 48, and appropriately status light 28. In certain circumstances, one or more portions of cavity 43 might be filled with an epoxy or other resin. This resin can assist in the prevention of fluid entry or other environmental exposure to components within cavity 43, and/or can assist in stabilizing components (e.g., processor 48) with respect to circuit board 46 to prevent vibration-induced damage.

Status light 28 is shown in FIG. 1 to include a first light emitting diode ("LED") 30 and a second LED 32 that protrude at least partially through housing 38. Alternate visual access might otherwise be provided to status light 28 (e.g., with lenses, windows, or the like) to facilitate visibility by an operator of nozzle 12. In alternative embodiments, such LEDs may be entirely recessed within a housing, but such a housing might be at least partially transparent or translucent in order that illumination generated by the status light may be visible to an operator of the associated nozzle.

Figure 2:
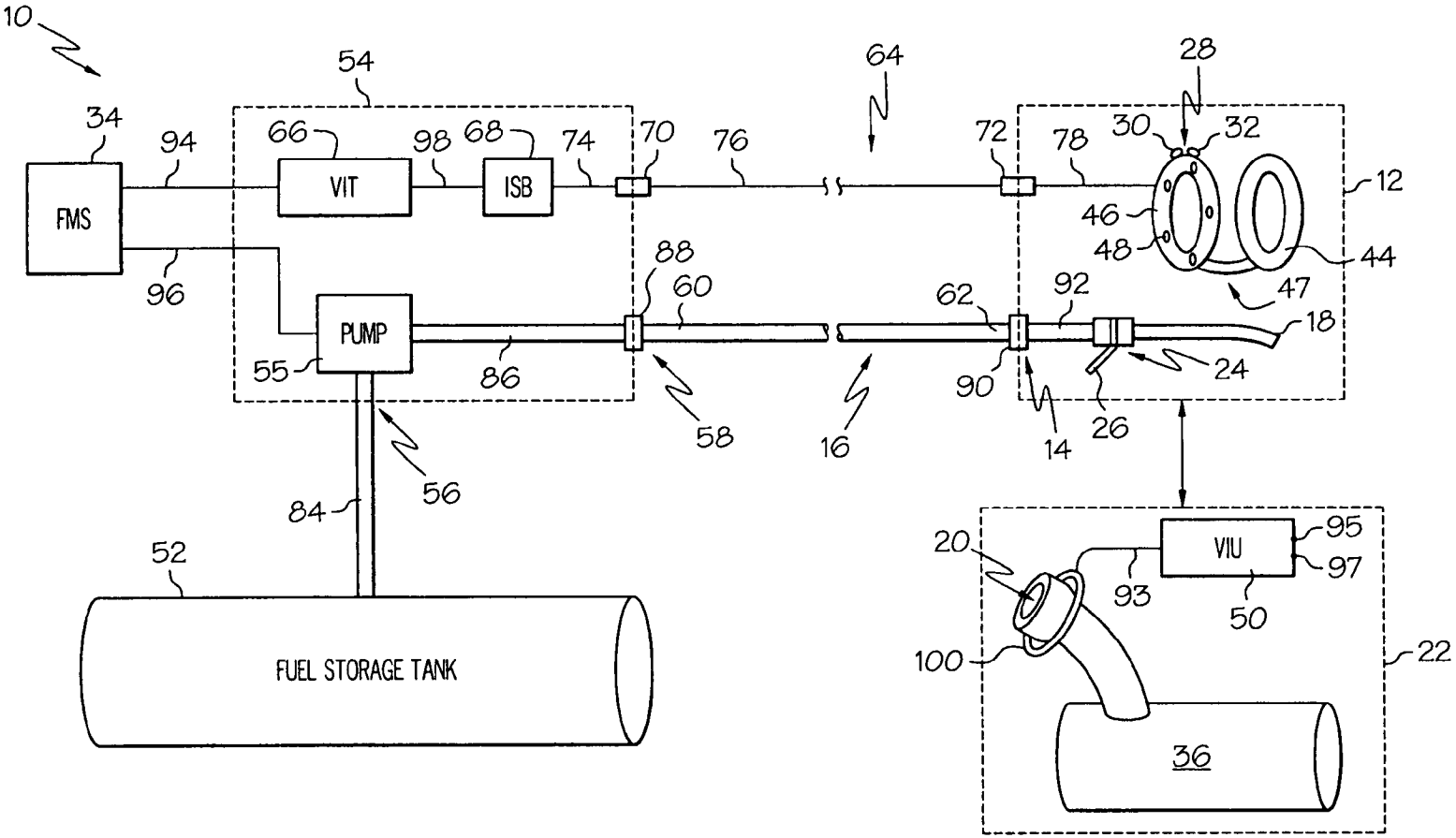
FIG. 2 is a schematic representation of an exemplary fuel dispensing system of the present invention incorporating the nozzle of FIG. 1.

Turning now to FIG. 2, an exemplary fuel dispensing system 10 of the present invention including nozzle 12 is depicted. Additional details of nozzle 12 are depicted in FIG. 2. For example, nozzle 12 is shown to include a third section 78 of cable 64 which is used to provide a connection between connector 72 and circuit board 46. Also, nozzle 12 is shown to include a fuel conduit 92 that couples input port 14 with valve assembly 24, and valve assembly 24 is shown to be connected with spout 18. Furthermore, antenna 44 is shown to connect with circuit board 46 by means of one or more wires 47, and first and second LEDs 30, 32 are shown to be directly connected to circuit board 46.

Fuel dispensing system 10 is also shown to include a fuel dispenser 54, which in some circumstances comprises a pedestal (not shown) at which an operator may rest the nozzle 12 when not in use. Fuel dispenser 54 is shown to include a connector 70 (e.g., a break-away connection) that couples with second section 76 of cable 64. Also, fuel dispenser 54 includes a connector 88 (e.g., a break-away connection) that is attached to the first end 60 of fuel supply hose 16 at a fuel outlet 58 of fuel dispenser 54.

Fuel dispenser 54 also includes a fuel inlet 56 for receiving fuel from an associated supply source. In particular, fuel inlet 56 is shown to include a fuel conduit 84 that leads to a source such as a fuel storage tank 52. A pump 55 can be provided to selectively pump fuel from fuel storage tank 52 through fuel conduit 84, and then through fuel conduit 86 toward fuel outlet 58 and nozzle 12. Hence, when pump 55 is instructed to operate, fuel is provided to nozzle 12 from fuel storage tank 52. However, when pump 55 is not operating, no fuel is provided to nozzle 12.

A control signal can be supplied to pump 55 via cable 96 to instruct pump 55 as to when to begin and end operation. This control signal can originate within or otherwise be provided by a fleet management system 34 that is part of the fuel dispensing system 10. Fleet management system 34 typically determines when fuel should be dispensed from fuel storage tank 52 to nozzle 12, and activates pump 55 accordingly. To make this determination, fleet management system 34 might verify that the vehicle is a member of an authorized fleet, that the vehicle is attempting to be filled in an authorized geographic location, that the fuel type is correct for the vehicle, that the time of day is appropriate for filling the vehicle, that the vehicle is in a location that corresponds with an authorized activity, that the fleet customer has not exceeded an available credit limit, and/or other information that may be relevant in determining whether to dispense fuel to a particular fleet vehicle. Although fleet management system 34 might be a single arrangement located within a control cabinet at the filling station (e.g., either in a building, in a dispenser pedestal, or in a free-standing cabinet), it might alternatively be provided as a combination of several arrangements which may be located remotely from each other and/or the filling station (e.g., at the fleet headquarters) but might be connected with dispenser pedestals at the filling station through use of wired or wireless phone or data connections.

In order to assess whether a vehicle is authorized to be fueled and/or is ready to be fueled by fuel dispensing system 10, fleet management system 34 relies upon nozzle 12 to obtain certain information from the vehicle to be filled. In particular, still referring to FIG. 2, an exemplary vehicle 22 provided with a fuel tank 36 having a fuel entry receptacle 20 into which nozzle 12 can dispense fuel is schematically shown. An antenna 100 can be associated with fuel entry receptacle 20 near the location of entry of nozzle 12. This antenna 100 can be connected via a cable 93 to a vehicle information unit 50. The vehicle information unit 50 can receive power from a vehicle's battery (e.g., through first port 95), and/or might also be directly or indirectly connected to one or more other components or systems on the vehicle. For example, vehicle information unit 50 can connect via second port 97 to the vehicle's speedometer, onboard computer, and/or some other sensor for detecting vehicle mileage and/or engine hours. In addition, vehicle information unit 50 may be configured to monitor alternate or additional aspects of vehicular operation (e.g., fuel tank level, oil level, or engine error status).

When spout 18 is inserted into fuel entry receptacle 20, antenna 44 of nozzle 12 will be located in a position near enough to antenna 100 to facilitate communication, and information can be transmitted therebetween. In particular, vehicle information unit 50 can provide, via antenna 100, precise authentication and/or other information to antenna 44. Antenna 44 can receive and pass this information (e.g., via wires 47) to circuit board 46. Processor 48 on circuit board 46 can process this information and pass it along third section 78 of cable 64, through connector 72, along second section 76 of cable 64, through connector 70, along a first section 74 of cable 64 and into an intrinsic safety barrier 68. Intrinsic safety barrier 68 can be provided to ensure that only suitable voltage and/or current levels are provided to nozzle 12 by dispenser 54 such that explosions and/or other hazardous situations may be prevented, and are well known in the art. The signal then passes along cable 98 from intrinsic safety barrier 68 to a vehicle information terminal 66. Vehicle information terminal 66 might then process this information, but can also pass a corresponding signal via cable 94 to fleet management system 34. Similarly, signals can be sent from fleet management system 34, through vehicle information terminal 66, cable 98, intrinsic safety barrier 68, cable 64, circuit board 46, antenna 44, and antenna 100 to vehicle information unit 50.

Although FIG. 2 only depicts vehicle information terminal 66 as being connected to a single nozzle 12 and pump 55, it should be understood that vehicle information terminal 66 can alternatively connect with a plurality of nozzles/pumps, and that multiple vehicle information terminals can be associated with a single fleet management system 34, depending of course upon the number of desired fueling points or nozzles at a particular fueling station. Also, it should be appreciated that the electrical connections within fuel dispenser 54 are discussed herein in a greatly simplified fashion, but can be achieved in numerous manners as will be well understood by those skilled in the art. Many other hardware and/or software configurations might be employed by a fuel dispensing system in accordance with the teachings of the present invention (e.g., to facilitate communication with a vehicle), as for example is disclosed in U.S. Pat. No. 5,605,182 which is hereby incorporated herein by reference.

In addition to the aforementioned functions, circuit board 46 also provides electrical signals to status light 28 to cause illumination of status light 28. These electrical signals can be generated in response to electrical signals received from antenna 44 and/or from fleet management system 34 (e.g., via vehicle information terminal 66). In one embodiment, status light 28 might include only a single LED (e.g., only LED 30). A status light 28 having only one LED (e.g., 30) is significantly smaller, simpler and less expensive to design and incorporate into a nozzle than would be a more complicated arrangement of plural LEDs or other displays, but still effectively provides authorization and/or fueling status information to an operator. However, in other embodiments of the present invention, status light 28 might be provided as two LEDs (e.g., 30, 32). In still further embodiments, status light 28 can comprise more than two LEDs. Regardless of whether status light 28 includes one or more LEDs, such LEDs can either be single-colored LEDs or multi-colored LEDs. Multi-colored LEDs can either have two leads or three leads, for example, and might even have more than three leads. Multi-colored LEDs can be adapted to illuminate in two colors, three colors, and/or more than three colors. LEDs are well suited for this application because they can be small, inexpensive, and lightweight, and because they can consume very little power, and can be visible in both daytime and nighttime conditions.

Status light 28 (e.g., one or more LEDs) can be directly or indirectly connected with fleet management system 34 and can be configured to selectively illuminate as directed by fleet management system 34. This connection between status light 28 and fleet management system 34 might involve intermediary components (e.g., vehicle information terminal 66, intrinsic safety barrier 68 and circuit board 46), as shown for example in FIG. 2. These intermediary components might also participate in passing directions or information from fleet management system 34 to status light 28, and might even enhance, compare, modify, or process information signals from fleet management system 34 before passing them onward to status light 28. For example, fleet management system 34 may only provide general information signals (e.g., that a vehicle is authorized) to vehicle information terminal 66, but vehicle information terminal 66 and circuit board 46 can operate to convert these general information signals into specific electrical signals for use in driving status light 28 to achieve the desired illumination (e.g., a slow green flashing pattern). These intermediary components might also provide some direction or otherwise implement the effective operation of status light 28 independent of fleet management system 34 so that appropriate guidance or feedback is provided to a user.

The illumination by status light 28 can provide information to an operator of nozzle 12 such as whether a vehicle is (or is not) authorized to receive fuel from nozzle 12. Status light 28 might also be configured to display information concerning status of pending authorization of the vehicle to receive fuel from spout 18. For example, status light 28 can be configured to indicate that nozzle 12 is communicating with the vehicle, that nozzle 12 is communicating with vehicle information terminal 66, and/or that vehicle information terminal 66 is communicating with fleet management system 34. As an additional example, status light 28 can be configured to indicate that nozzle 12 is awaiting further processing or a reply (e.g., approval, confirmation) by fleet management system 34 or vehicle information terminal 66. As still another example of providing information concerning status of pending authorization, status light 28 can be configured to provide one or more instructional prompts to an operator (e.g., requiring an operator to input driver identification information, requiring an operator to stop the vehicle's engine, and/or requiring an operator to perform some other verifiable task), whereby an operator might have to appropriately act before fueling is permitted.

Additionally or alternatively, status light 28 can be configured to display information concerning whether fuel is being dispensed from the spout at any given time. In this manner, an operator of nozzle 12 can receive visual confirmation from nozzle 12 that it is dispensing fuel. In still other embodiments, status light 28 can be configured to display certain diagnostic information about a vehicle being fueled. This diagnostic information can be gathered by the vehicle information unit 50 and can then be transferred to the nozzle 12 through antennas 100 and 44. The status light 28 can then selectively illuminate in order to pass this information onto an operator. As one particular example, status light 28 might be configured to indicate whether a vehicle's fuel tank 36 has been filled or is nearly full (information which might be detected by a switch or float associated with a vehicle's fuel tank, transmitted to vehicle information unit 50, and then passed from vehicle information unit 50 to nozzle 12 via antennas 100 and 44). As other examples, status light 28 might be operative to display information concerning a vehicle's mileage, average miles per gallon, engine hours, vehicle identification number, the type of fuel required by the vehicle, windshield washer fluid level, oil level, and/or any of a variety of other pieces of useful information that may be monitored or gathered by vehicle information unit 50. Status light 28 might additionally or alternatively be configured to indicate when the fueling transaction has been completed and/or when nozzle 12 is idle but is otherwise ready to begin a new transaction.

Status light 28 can also or alternatively display information concerning whether an error has occurred that prevents fuel from being dispensed from the spout 18, and perhaps might even display information concerning the precise nature of the error. Such errors might include a communications error, a time out error, or a declination of authorization, for example. Authorization might be declined, for example, when an invalid vehicle is attempted to be filled, a pump is not valid for filling a particular vehicle, or a pump is already in use.

In one specific embodiment, status light 28 can comprise a single LED 30 that is configured to display information concerning status of pending authorization of a vehicle to receive fuel from spout 18, whether fuel is being dispensed from spout 18, and whether an error has occurred that prevents fuel from being dispensed from spout 18. This single LED 30 can provide an operator with multiple different status conditions by illuminating in different colors and/or different flash patterns. In another specific embodiment, status light 28 comprises first and second LEDs 30, 32 that together are configured to selectively provide information concerning status of pending authorization of a vehicle to receive fuel from spout 18, whether fuel is being dispensed from spout 18, and whether an error has occurred that prevents fuel from being dispensed from spout 18. In yet another specific embodiment, status light 28 comprises first and second LEDs 30, 32 that together are configured to selectively provide information concerning at least one of status of pending authorization of a vehicle to receive fuel from spout 18, whether fuel is being dispensed from spout 18, whether an error has occurred that prevents fuel from being dispensed from spout 18, and the nature of the error.

Illumination of one or both of the first and second LEDs 30, 32 in different colors and/or different flash patterns can provide an operator with information regarding multiple status conditions of fuel dispensing system 10 and/or of vehicle 22. In these ways, a status light can provide a simple and effective information source for an operator of a fuel dispensing nozzle.

A legend, placard, label, or other indication might be provided (e.g., on or near nozzle 12 or dispenser 54) as a guide for an operator to reference when interpreting what is meant by the status light illumination. For example, an exemplary nozzle having a single two-color LED status light can have writing affixed to the body of the nozzle to indicate what is meant by the various available illumination patterns of the LED. In one embodiment, this writing might indicate that solid or continuous green illumination indicates that the system is idle and that the previous transaction is completed, quickly alternating green and red illumination might indicate that the vehicle identification unit is communicating, slowly alternating green and red illumination might indicate that validation is pending, slow green flashing illumination indicates authorization, fast green flashing illumination might indicate that the nozzle is in use (i.e., dispensation), and red flashing illumination might indicate an error (e.g., two flashes indicate invalid site, three flashes indicate invalid vehicle). The writing might comprise symbols in addition to text or in lieu of text to aid an operator in understanding the meaning of the various available status light illumination patterns.

As previously discussed with respect to FIG. 2, the housing 38 associated with nozzle 12 can at least partially enclose antenna 44 and circuit board 46 such that each of these devices are associated with nozzle 12. In one exemplary embodiment of the present invention, processor 48 on circuit board 46 can be electrically connected with both antenna 44 and status light 28, such that processor 48 is configured to assist in directly or indirectly effectively connecting status light 22 and antenna 44 with fleet management system 34. It shall be appreciated that this connection between status light 28, antenna 44 and fleet management system 34 may also include many other components as shown for example in FIG. 2. Such components can include cables (e.g., 64), connectors (e.g., 70, 72), vehicle information terminal 66, intrinsic safety barrier 68, and/or any other device, network, or algorithm that intervenes along the path(s) of signal flow between status light 22, antenna 44 and fleet management system 34.

In the configuration depicted in FIG. 2, for example, analog radio frequency (RF) signals from antenna 44 need only be communicated a short distance to circuit board 46, as opposed to having to be transmitted all the way back to dispenser 54. In such a configuration, data to/from antenna 44 can be processed digitally by processor 48 and/or by other components of circuit board 46 such that any transmission between nozzle 12 and dispenser 54 can be communicated over a digital connection (e.g., as opposed to an analog connection). By limiting the length of analog RF transmission in this manner, the likelihood of undesired electromagnetic interference is significantly diminished and less power may be required for signal transmission to/from the nozzle. However, a system in accordance with the present invention could alternatively be configured such that analog RF signals from a nozzle antenna are communicated through a cable the entire distance back to the dispenser.

Cable 64 is shown in FIG. 2 to assist in facilitating an electrical connection between processor 48 and fleet management system 34. In one embodiment, cable 64 might only include three wires. The first wire can provide power (e.g., +12 VDC) from dispenser 54 to circuit board 46, the second wire can provide a power/signal ground from dispenser 54 to circuit board 46, and the third wire can provide data communication between dispenser 54 and circuit board 46. It should, however, be appreciated that cable 64 might alternatively involve a different number of wires.

Also, it should be appreciated that a wireless connection (e.g., involving RF or optical communication) could be employed in lieu of cable 64, such that a nozzle can wirelessly communicate with a dispenser and/or a fleet management system. In such a wireless embodiment, rechargeable or non-rechargeable batteries, or even capacitors, might be associated with the nozzle to provide power for the circuit board and status light. The batteries could either be replaced when worn, or could alternatively be recharged through electrical contacts (e.g., engaged when the nozzle is stored during non-use within the pedestal), inductively through RF communication, optically through light transmission, or mechanically (e.g., via fuel-driven dynamo).

It should be appreciated that a fuel dispensing system in accordance with the teachings of the present invention might be operable to dispense gasoline, diesel fuel, fuel oil, kerosene, jet fuel, and/or any of a variety of other petroleum products, or might even be operable to dispense hydrogen, propane, and/or any of a variety of non-petroleum fuels. It shall also be appreciated that a fuel dispensing system in accordance with the teachings of the present invention might alternatively be configured to dispense electricity to a vehicle. In such a circumstance, the fuel supply hose might comprise an electrical cable, the valve assembly might comprise an electrical switch, and the spout might comprise an electrical connector.

The foregoing description of exemplary embodiments and examples of the invention has been presented for purposes of illustration and description. These examples and descriptions are not intended to be exhaustive or to limit the invention to the forms described. Numerous modifications are possible in light of the above teachings. Some of those modifications have been discussed, and others will be understood by those skilled in the art. It is hereby intended that the scope of the invention be defined by the claims appended hereto.

What is claimed is:

1. A nozzle for a fuel dispensing system that is adapted to deliver fuel to fleet vehicles, the nozzle comprising:

an input port being adapted to receive fuel through a fuel supply hose;

a spout being configured to dispense fuel into a fuel entry receptacle of a vehicle;

a valve assembly being configured to couple the input port with the spout, and being further configured to selectively facilitate the passage of fuel from the input port to the spout; and a status light associated with the nozzle and comprising a single LED connected with a fleet management system, the status light being configured to selectively illuminate as directed by a fleet management system, whereby said illumination provides information as to whether a vehicle is a member of an authorized fleet and therefore whether the vehicle is authorized to receive fuel from the spout.

2. The nozzle of claim 1, wherein said LED is further configured to display information concerning status of pending authorization of a vehicle to receive fuel from the spout.

3. The nozzle of claim 1, wherein said LED is further configured to display information concerning whether fuel is being dispensed from the spout.

4. The nozzle of claim 1, wherein said LED is further configured to display information concerning whether an error has occurred that prevents fuel from being dispensed from the spout.

5. The nozzle of claim 4, wherein said LED is configured to indicate the nature of the error.

6. The nozzle of claim 1, wherein said LED is further configured to display information concerning:

a) status of pending authorization of a vehicle to receive fuel from the spout;

b) whether fuel is being dispensed from the spout; and c) whether an error has occurred that prevents fuel from being dispensed from the spout.

7. The nozzle of claim 1, wherein said LED comprises a single-colored LED.

8. The nozzle of claim 1, wherein said LED comprises a multi-colored LED.

9. The nozzle of claim 1, further comprising a housing, an antenna, and a processor, the housing being associated with the spout and at least partially enclosing the antenna, the processor, and the status light, wherein the processor is electrically connected with both the antenna and the status light.

10. A nozzle for a fuel dispensing system that is adapted to deliver fuel to fleet vehicles, the fleet vehicles having an integrated vehicle identification unit, the nozzle comprising:

an input port being adapted to receive fuel through a fuel supply hose;

a spout being configured to dispense fuel into a fuel entry receptacle of a vehicle;

a valve assembly being configured to couple the input port with the spout, and being further configured to selectively facilitate the passage of fuel from the input port to the spout;

an antenna associated with the nozzle and being configured to communicate with a vehicle; and a status light associated with the nozzle and comprising a first LED connected with a fleet management system, the status light being configured to selectively illuminate as directed by a fleet management system, whereby said illumination provides information as to whether a vehicle is a member of an authorized fleet and therefore whether the vehicle is authorized to receive fuel from the spout.

11. The nozzle of claim 10, wherein the status light further comprises a second LED being associated with the nozzle, being connected with a fleet management system and being configured to selectively illuminate as directed by a fleet management system.

12. The nozzle of claim 11, whereby said illumination of at least one of the first and second LEDs is configured to selectively provide information concerning at least one of:

a) the status of pending authorization of a vehicle to receive fuel from the spout;

b) whether fuel is being dispensed from the spout;

c) whether an error has occurred that prevents fuel from being dispensed from the spout; and d) the nature of the error.

13. The nozzle of claim 11, whereby said illumination of at least one of the first and second LEDs is configured to selectively provide information concerning:

a) status of pending authorization of a vehicle to receive fuel from the spout;

b) whether fuel is being dispensed from the spout; and c) whether an error has occurred that prevents fuel from being dispensed from the spout.

14. The nozzle of claim 10, further comprising a housing and a processor, the housing being associated with the spout and at least partially enclosing the antenna, the processor, and the status light, wherein the processor is electrically connected with both the antenna and the status light.

15. A fuel dispensing system for automatically and conveniently providing fuel to fleet vehicles, the fleet vehicles having an integrated vehicle identification unit, the system comprising:

a fuel storage tank;

a fuel dispenser having a fuel inlet and a fuel outlet, the fuel inlet being connected with the fuel storage tank, the fuel dispenser being configured to facilitate selective passage of fuel from the fuel inlet to the fuel outlet in response to a control signal;

a fleet management system being configured to determine if a vehicle is authorized to receive fuel and being configured to provide the control signal and a monitoring signal;

a fuel supply hose having a first end and a second end, the first end being connected to the fuel outlet, and the fuel supply hose being configured to conduct fuel from the first end to the second end; and a fuel nozzle comprising:

an input port connected to the second end of the fuel supply hose, the input port being adapted to receive fuel from the fuel supply hose;

a spout being configured to dispense fuel into a fuel entry receptacle of a vehicle;

a valve assembly being configured to couple the input port with the spout, and being further configured to facilitate selective passage of fuel from the input port to the spout; and a status light associated with the nozzle and comprising at least one LED being configured to selectively illuminate as directed by the monitoring signal from the fleet management system, whereby said illumination provides information as to whether a vehicle is a member of an authorized fleet and therefore whether the vehicle is authorized to receive fuel from the spout.

16. The fuel dispensing system of claim 15 wherein the nozzle further comprises an antenna for communicating with a vehicle.

17. The fuel dispensing system of claim 16 wherein the antenna is configured to receive information from a vehicle.

18. The fuel dispensing system of claim 17 wherein the antenna is configured to transmit information to a vehicle.

19. The fuel dispensing system of claim 16 wherein the nozzle further comprises a processor configured to effectively connect the status light and the antenna with the fleet management system.

20. The fuel dispensing system of claim 19 further comprising a cable associated with the fuel supply hose and connecting the processor with the fleet management system.

* * * * *